United States Patent [19]

Bridges et al.

[11] Patent Number: 4,919,201

[45] Date of Patent: Apr. 24, 1990

[54] CORROSION INHIBITION APPARATUS FOR DOWNHOLE ELECTRICAL HEATING

[75] Inventors: Jack E. Bridges, Park Ridge; George T. Dubiel; Thomas J. Bajzek, both of Wood Dale, all of Ill.

[73] Assignee: Uentech Corporation, Denver, Colo.

[21] Appl. No.: 322,912

[22] Filed: Mar. 14, 1989

[51] Int. Cl.[5] ..... E21B 43/24

[52] U.S. Cl. ..... 166/60; 166/65.1; 166/902; 204/147; 204/196

[58] Field of Search ..... 166/248, 65.1, 60, 53, 166/902; 219/277, 278; 204/196, 147

[56] References Cited

U.S. PATENT DOCUMENTS

| | | | |
|---|---|---|---|
| 2,801,697 | 8/1957 | Rohrback | 166/902 |
| 3,220,942 | 11/1965 | Crites | 204/196 |
| 3,642,066 | 12/1972 | Gill | 166/60 X |
| 3,674,662 | 7/1972 | Haycock | 204/196 X |
| 3,724,543 | 4/1973 | Bell et al. | 166/248 |
| 3,734,181 | 5/1973 | Shaffer | 166/65.1 |
| 4,010,799 | 3/1977 | Kern et al. | 166/248 |
| 4,211,625 | 7/1980 | Vandevier et al. | 204/196 X |
| 4,413,679 | 11/1983 | Perkins | 166/248 |
| 4,790,375 | 12/1988 | Bridges et al. | 166/60 |
| 4,793,409 | 12/1988 | Bridges et al. | 166/57 |

*Primary Examiner*—Hoang C. Dang
*Attorney, Agent, or Firm*—Kinzer, Plyer, Dorn, McEachran & Jambor

[57] ABSTRACT

Corrosion inhibition apparatus in an electromagnetic heating system for in situ downhole heating in an oil well or other mineral fluid well that includes an A.C. power source for a high amperage, low frequency heating current (e.g. over 50 amperes at 0.01 to 35 Hz) and a D.C. bias source for generating a low amplitude (e.g., less than one ampere) current for corrosion inhibition, both sources connected to a downhole electrode. The bias source includes at least one semiconductor device, connected in the main A.C. heating circuit, in a bias circuit that develops a net D.C. voltage differential of the polarity required for corrosion inhibition in response to the A.C. heating current.

28 Claims, 4 Drawing Sheets

SWITCHING A.C. TO D.C. CONVERTER
D.C. BIAS SUPPLY
LOAD
A.C. CURRENT SENSOR
D.C. VOLTAGE SENSOR
D.C. CURRENT SENSOR
HEATING CONTROL
FROM WELL SENSORS
POWER SOURCE 635

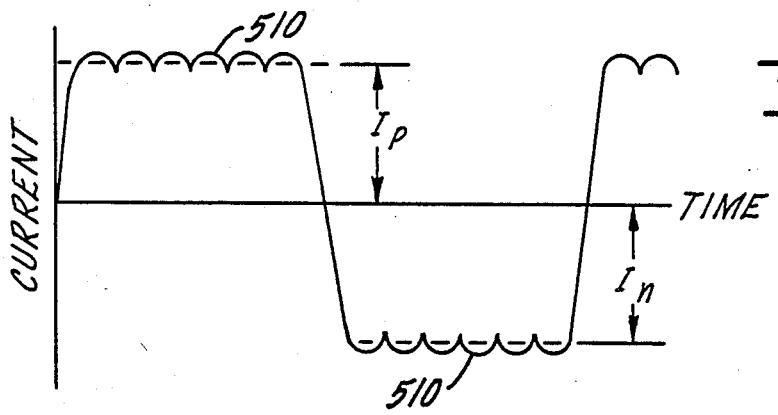
Fig. 4A.
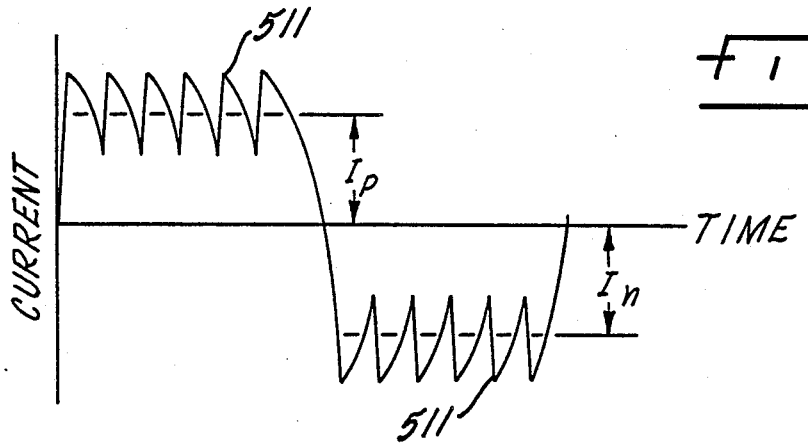
Fig. 4B.
Fig. 8.
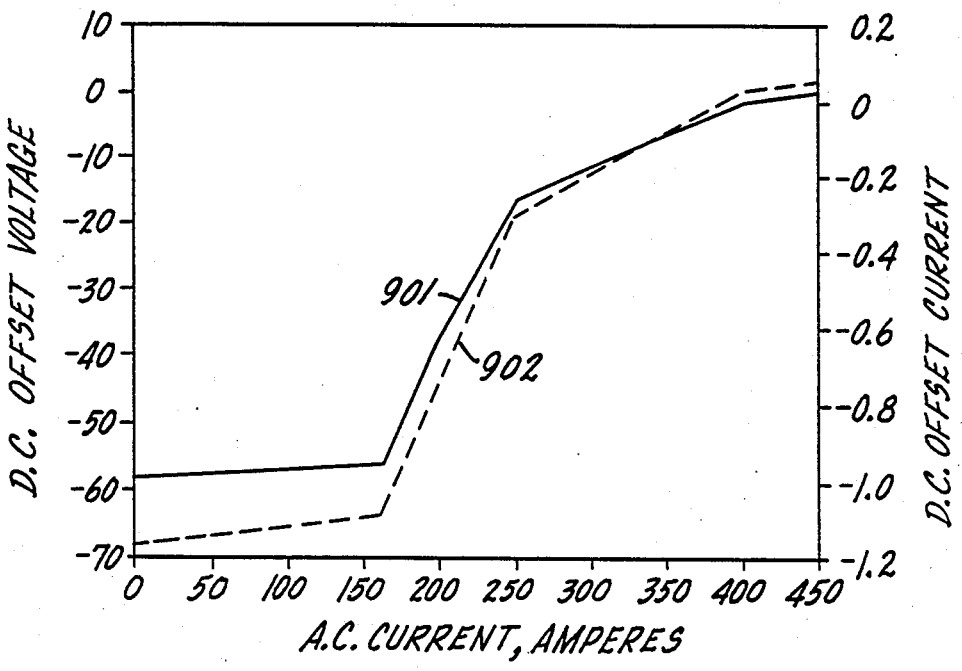

CORROSION INHIBITION APPARATUS FOR DOWNHOLE ELECTRICAL HEATING

BACKGROUND OF THE INVENTION

In-place reserves of heavy oil in the United States have been estimated about one hundred fifty billion barrels. Of this large in-place deposit total, however, only about five billion barrels may be considered economically produceable at current oil prices. One major impediment to production of oil from such deposits is the high viscosity of the oil. The high viscosity reduces the rate of flow through the deposit, particularly in the vicinity of the well bore, and consequently increases the capital costs per barrel so that overall costs per barrel become excessive.

Various techniques have been tried to stimulate flow from wells in heavy oil deposits. One technique utilizes steam to heat the oil around the well; this method has been utilized mostly in California. However, steam has drawbacks in that it is not applicable to thin reservoirs, is not suitable for many deposits which have a high clay content, is not readily applicable to off-shore deposits, and cannot be used where there is no adequate water supply.

There have also been a number of proposals for the use of electromagnetic energy, usually at conventional power frequencies (50/60 Hz) but sometimes in the radio frequency range, for heating oil deposits in the vicinity of a well bore. In field tests, it has been demonstrated that electromagnetic energy can thus be used for local heating of the oil, reducing its viscosity and increasing the flow rate. A viscosity reduction for oil in the immediate vicinity of the well bore changes the pressure distribution in the deposit to an extent such that flow rates may be enhanced as much as three to six times.

Perhaps the most direct and least costly method of implementation of electromagnetic heating of deposits in the vicinity of a well bore utilizes existing oil well equipment and takes advantage of conventional oil field practices. Thus, conventional steel well casing or production tubing may be employed as a part of the conductor system which delivers power to a main heating electrode located downhole in the well, at the level of the oil or gas deposit. However, the high magnetic permeability of a steel casing or tubing, with the associated eddy current and hysteresis losses, often creates excessive power losses in the transmission of electrical energy down through the wellbore to the main electrode. Such power losses are significant even at the conventional 50/60 Hz supply frequencies that are used almost universally. These losses may be mitigated by reducing the A.C. power frequency, as transmitted to the downhole heating electrode, but this creates some substantial technical problems as regards the electrical power source, particularly if the system must be energized from an ordinary 50/60 Hz power line.

Many of the technical difficulties in the use of low frequency A.C. power in heating oil and like deposits to improve well production are effectively solved by the power sources described and claimed in the co-pending U.S. patent application Ser. No. 322,930, of J. E. Bridges et al, filed simultaneously herewith. But other problems, particularly corrosion problems, remain.

A major difficulty with the use of low frequency A.C. power for localized heating of deposits in a heavy oil well arises because corrosion effects at low frequencies (e.g., below thirty-five Hz) are substantially enhanced in comparison with the corrosion that occurs in heating systems using conventional power frequencies of 50/60 Hz. Thus, for extended well life it is important to incorporate cost effective corrosion protection in the heating system.

Conventional corrosion protection arrangements for pipelines and oil wells usually include coating the pipe, casing, tubing, etc., of whatever configuration, with a layer of insulator material. In an electromagnetic heating system for an oil well, which must deliver power to a main heating electrode located far downhole at the oil deposit level, a secondary or return electrode is also required. That is, there are two exposed, uninsulated electrodes in the system, a main electrode downhole in the region of the oil deposit and a return electrode spaced from the main electrode. The secondary electrode is usually located above the deposit. To maintain conduction and heating, these electrodes must be positioned so that electrical energy flowing between them passes through a localized portion of the deposit. Accordingly, surface insulation can be used on only a portion of the electromagnetic well heating system. The most critical element, of course, is the exposed main heating electrode located downhole in the deposit; it cannot easily be replaced. Thus, corrosion damage to the downhole main heating electrode may shorten the life of the heating system substantially and may greatly reduce its economic value.

Cathodic protection has been widely used for pipelines, oil wells, and other similar applications. This technique involves maintenance of a buried metal component, insulated or exposed, at a negative potential with respect to the earth. In this way, positive metallic ions that would normally be driven out from the buried metal element are attracted back into it, suppressing the corrosion rate. Of course, this requires that another exposed metal element or electrode be placed in the earth and maintained at a positive potential. In cathodic protection, as otherwise in the physical world, there is no free lunch. The positive D.C. potential of the secondary electrode drives the positively charged metallic ions into the earth and causes corrosion at the secondary electrode, the anode, at a rate that is a function of the D.C. bias current and the metallic constituents of the anode. Consequently, the positively charged return electrode is sometimes called the "sacrificial electrode". Sacrificial electrodes are usually designed either to be replaced or to have sufficient metal or chemical constituents so that they can withstand continued corrosion losses over an acceptable life for the system. Long life secondary electrodes (e.g., high silicon steel) are of material assistance in keeping secondary electrodes in service, but even this expedient is inadequate if large D.C. currents are tolerated.

Conventional cathodic protection systems cannot handle the large A.C. currents (e.g., 50 to 1000 amperes) often required for effective electromagnetic downhole heating in oil wells and like mineral fluid wells. This is especially true for currents in a low frequency range, such as between 0.01 and 35 Hz. Another difficulty with some of the known cathodic protection systems is that they are predicated upon application of a fixed potential large enough to assure that the protected metallic equipment (in this instance the downhole main heating electrode) is always negative with respect to the earth. But corrosion related currents and voltages vary with changes in heating currents. For an electromagnetically heated oil well, the rate of heating required for efficient operation may vary with changes in the production rate of the well, its oil/water ratio, the electrochemical constituents of the reservoir fluids, and other factors. Even in non-reservoir formations, these phenomena impose variable requirements with respect to the D.C. corrosion-protection bias. As a consequence, for most conventional cathodic protection systems excessive voltage requirements are imposed, with the result that there is excessive corrosion (and loss of efficiency) at the return electrode. The return electrode is likely to be overdesigned and undesirably expensive; D.C. power requirements are also excessive.

Further, maintaining the electrode in the deposit at too large a negative potential can cause a buildup of scale that may plug casing perforations or screens in this part of the well. Such excess scale accumulation at the downhole electrode is quite undesirable. Depending on the specifics of the application, it may be desirable to reduce the D.C. component of the current between the electrodes to as small a value as possible or to hold the downhole electrode at the least practical negative potential. This suppresses scale buildup on the reservoir electrode and reduces anodic corrosion losses at the return electrode.

There is another type of oil well heating system in which the heat is applied to the flow of oil within the well itself, rather than to a localized portion of the deposit around the well. Such a heating system, usually applied to paraffin prone wells, is described in the Bridges et al U.S. Pat. No. 4,790,375, issued Dec. 13, 1988. In a system of this kind the heating element or elements constitute the casing, the production tubing, or both; the high hysteresis and eddy current losses in steel tubing make its use frequently advantageous. In such systems it is frequently desirable to supply heating power to the system at frequencies substantially above the normal power range of 50/60 Hz, but corrosion problems generally similar to those in low frequency deposit heating systems may occur.

Exemplary and advantageous systems and apparatus for combined performance of the A.C. heating and D.C. corrosion inhibition functions are described in detail in the copending application of J. E. Bridges, Ser. No. 322,930, filed concurrently herewith. In some of those systems, however, provision of an effective D.C. bias source presents substantial difficulties; conventional devices, when energized from the usually available 50/60 Hz power lines, are unduly expensive, do not perform well, and cannot accommodate the large A.C. heating currents that are required.

SUMMARY OF THE INVENTION

The primary object of the present invention, therefore, is to provide a new and improved controllable D.C. bias source, suitable for use in an electromagnetic downhole heating system for oil wells and other mineral fluid wells, that can accommodate large A.C. heating currents (e.g. 50 to 1000 amperes or more), yet is simple and inexpensive in construction and reliable in operation.

Accordingly, the invention is utilized in an electromagnetic heating system for an oil well or other mineral fluid well, including a main heating electrode located downhole in the well at a level adjacent a mineral fluid deposit, and a return electrode located such that an electrical current between the electrodes passes through and heats a portion of the mineral fluid deposit, an electrical energizing apparatus including an A.C. power source for generating a high amplitude A.C. heating current, of at least fifty amperes, a D.C. bias source for generating a low amplitude D.C. bias current having a polarity such as to inhibit corrosion at the main electrode, and connection means for applying both the A.C. heating current and the D.C. bias current to the electrodes of the well heating system. According to the invention, the D.C. bias source comprises a bias circuit, connected to a heating circuit that includes the A.C. power source, the bias circuit including at least one semiconductor device and developing a net D.C. voltage differential of the given polarity in response to the A.C. heating current.

BRIEF DESCRIPTION OF THE DRAWINGS

FIGS. 4A and 4B are electrical waveform diagrams utilized in explanation of the operation of the apparatus of FIG. 3;

FIG. 8 is a chart of D.C. current variations responsive to changes in A.C. heating current.

DESCRIPTION OF THE PREFERRED EMBODIMENTS

Figure 1:
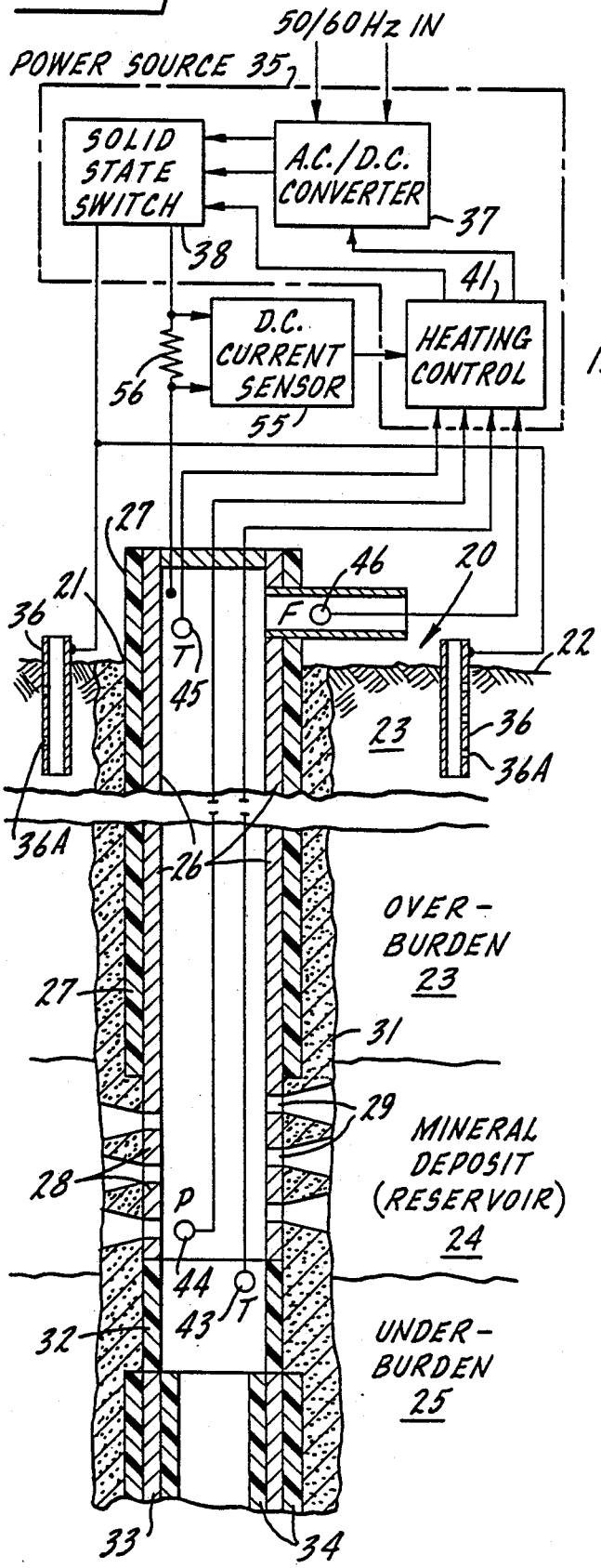
FIGS. 1 and 2 are simplified schematic sectional elevation views of two different oil wells, each equipped with a downhole electromagnetic heating system including an energizing apparatus in a system that affords effective cathodic protection to a main downhole heating electrode.

FIG. 1 illustrates a mineral well 20, specifically an oil well, that comprises a well bore 21 extending downwardly from a surface 22 through an extensive overburden 23, which may include a variety of different formations. Bore 21 of well 20 continues downwardly through a mineral deposit or reservoir 24 and into an underburden formation 25. An electrically conductive casing 26, usually formed of low carbon steel, extends downwardly into well bore 21 from surface 22. Casing 26 may have an external insulator layer 27 from surface 22 down to the upper level of deposit 24. The portion of casing 26 that traverses the deposit or reservoir 24 is not covered by an insulator; it is left exposed to afford a heating electrode 28 that includes a multiplicity of apertures 29 for oil to enter casing 26 from reservoir 24.

Casing 26 and its external insulation 27 may be surrounded by a layer of grout 31. In the region of deposit 24, grout 31 has a plurality of openings aligned with apertures 29 in electrode 28 so that it does not interfere with admission of oil into casing 26. Alternatively, the grouting may be discontinued in this portion of well 20. Below reservoir 24, in underburden 25, a casing section 32 of an electrical insulator such as resin-impregnated fiberglass may be incorporated in series in casing 26. Below the insulation casing section 32 there may be a further steel casing section 33, preferably provided with internal and external insulation layers 34, as described in greater detail in Bridges et al U.S. Pat. No. 4,793,409, issued Dec. 27, 1988, which also discloses preferred methods of forming the insulation layer 27 on casing 26.

Oil well 20, FIG. 1, has an electromagnetic heating system that includes a power source 35 supplied from a conventional electrical supply operating at the usual power frequency of 50 Hz or 60 Hz, depending upon the country in which oil well 20 is located. The heating system for well 20 further comprises the main heating electrode 28, constituting an exposed perforated section of casing 26, and a return electrode shown as a plurality of electrically interconnected conductive electrodes 36 each extending a substantial distance into the earth from surface 22. Electrodes 28 and 36 are electrically connected to power source 35; electrodes 36 preferably include apertures 36A.

Power source 35 includes an A.C. to D.C. converter 37 connected by appropriate means to an external 50/60 Hz electrical supply. Converter 37 supplies an intermediate D.C. output to a switch unit 38 that repetitively samples the D.C. output from the converter, at a preselected sampling frequency, to develop an A.C. heating current that is applied to electrodes 28 and 36. The connection to electrode 28 is made through casing 26, of which electrode 28 is a component part.

Power source 35 additionally comprises a heating rate control circuit 41 that is connected to converter 37 and to solid state switch unit 38. Heating control circuit 41 maintains the sampling rate for the switches in circuit 38 at a frequency substantially different from 50/60 Hz; in well 20, this sampling rate is preferably in a range of 0.01 to 35 Hz. The heating control 41 in well 20 has inputs from one or more sensors. Such sensors may include a temperature sensor 43 and a pressure sensor 44 positioned in the lower part of casing 26 to sense the temperature and pressure of oil in this part of the well. A thermal sensor 45 may be located near the top of the well, as may a flow sensor 46. Control circuit 41 adjusts the power content and frequency of the A.C. heating current delivered from switching unit 38 to electrodes 28 and 36, based on its inputs from sensors such as devices 43–46.

Figure 2:
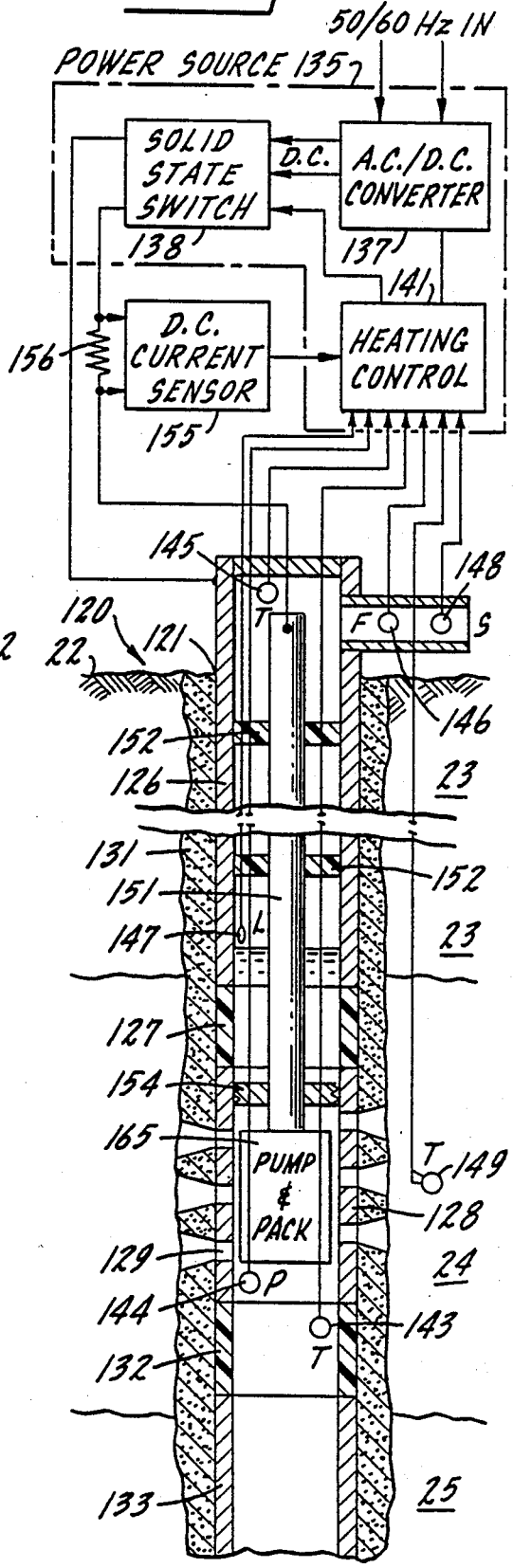

FIG. 2 illustrates another well 120 comprising a well bore 121 again extending from surface 22 down through overburden 23 and deposit 24, and into underburden 25. Well 120 has a steel or other electrically conductive casing 126 which in this instance has no external insulation; casing 126 is encompassed by a layer of grout 131. Electrical conductivity of the well casing is interrupted by an insulator casing section 127 preferably located just below the interface between overburden 23 and mineral deposit 24. A further conductive casing section 128 extends below section 127. Casing section 128 is provided with multiple perforations 129 and constitutes a main heating electrode for heating a part of deposit 24 immediately adjacent well 120. An insulator casing 132 extends into the rathole of well 120, below reservoir 24. The rathole of well 120 may also include an additional length of conductive casing 133, in this instance shown uninsulated.

The heating system for well 120, including its power source 135, is similar to the system for well 20 of FIG. 1, except that there are no separate return electrodes. In well 120, FIG. 2, casing 126 serves as the return electrode and is electrically connected to a solid state switching unit 138 in power source 135. Switching unit 138 is energized from an A.C. to D.C. conversion circuit 137 connected to a conventional 50/60 Hz supply. Power source 135 includes a heating control 141. In this instance, the heating control circuit is shown as having inputs from a downhole temperature sensor 143, a pressure sensor 144, a well head temperature sensor 145, and an output flow sensor 146. A further input to control 141 may be derived from a liquid level sensor 147 in the annulus between casing 126 and a production tubing 151 in well 120. Additional inputs to heating control 141 may be derived from a specific heat sensor 148 shown located in the output conduit from well 120 or from a thermal sensor 149 positioned in deposit 24.

In well 120, the central production tubing 151 extends down through casing 126 to the level of the oil deposit 24. A series of electrical insulator spacers 152 isolate tubing 151 from casing 126 throughout the length of the tubing. Tubing 151 is formed from an electrical conductor; aluminum tubing or the like is preferred but steel tubing may also be used.

Adjacent the top of deposit 24, the insulator casing section 127 isolates the upper casing 126 from the main heating electrode 128 of well 120. An electrically conductive spacer and connector 154, located below insulator casing section 127, provides an effective electrical connection from tubing 151 to electrode 128. Connector 154 should be one that affords a true molecular bond electrical connection from tubing 151 to the electrode, casing section 128. A conventional pump and gravel pack 165 may be located below connector 154.

The wells shown in FIGS. 1 and 2 will be recognized as generally representative of a large variety of different types of electromagnetic heating systems applicable to oil wells and to other installations in which a portion of a mineral deposit is heated in situ. Thus, the return electrode for well 20 could be the conductive casing of another oil well in the same field, rather than the separate return electrodes 36. In this specification any reference to the wells and heating systems of FIGS. 1 and 2, should be understood to encompass these and other reasonable variations of the wells and the well heating systems.

Each of the well heating systems of FIGS. 1 and 2 includes additional apparatus used for the control of effective, efficient and economical cathodic protection for the downhole main heating electrodes 28 (FIG. 1) and 128 (FIG. 2). Thus, in FIG. 1 a D.C. current sensor 55 is connected to the electrode energizing circuit, more particularly to a resistor 56 that is connected in series in the circuit connecting solid state switch 38 to casing 26 and hence to main electrode 28. Thus, sensor 55, in conjunction with its shunt resistor 56, monitors the D.C. current flowing in the heating circuit comprising switch unit 38, casing 26, electrode 28, and electrodes 36. The output of sensor 55 is supplied to heating control 41 for use in varying a small negative D.C. bias current to the main electrode 28, as described more fully hereinafter. In FIG. 2 a similar D.C. current sensor 155, using a shunt resistor 156 in the heating circuit connecting switch unit 138 to production tubing 151, provides the same information to heating control 141.

Figures 3, 5A, 5B:
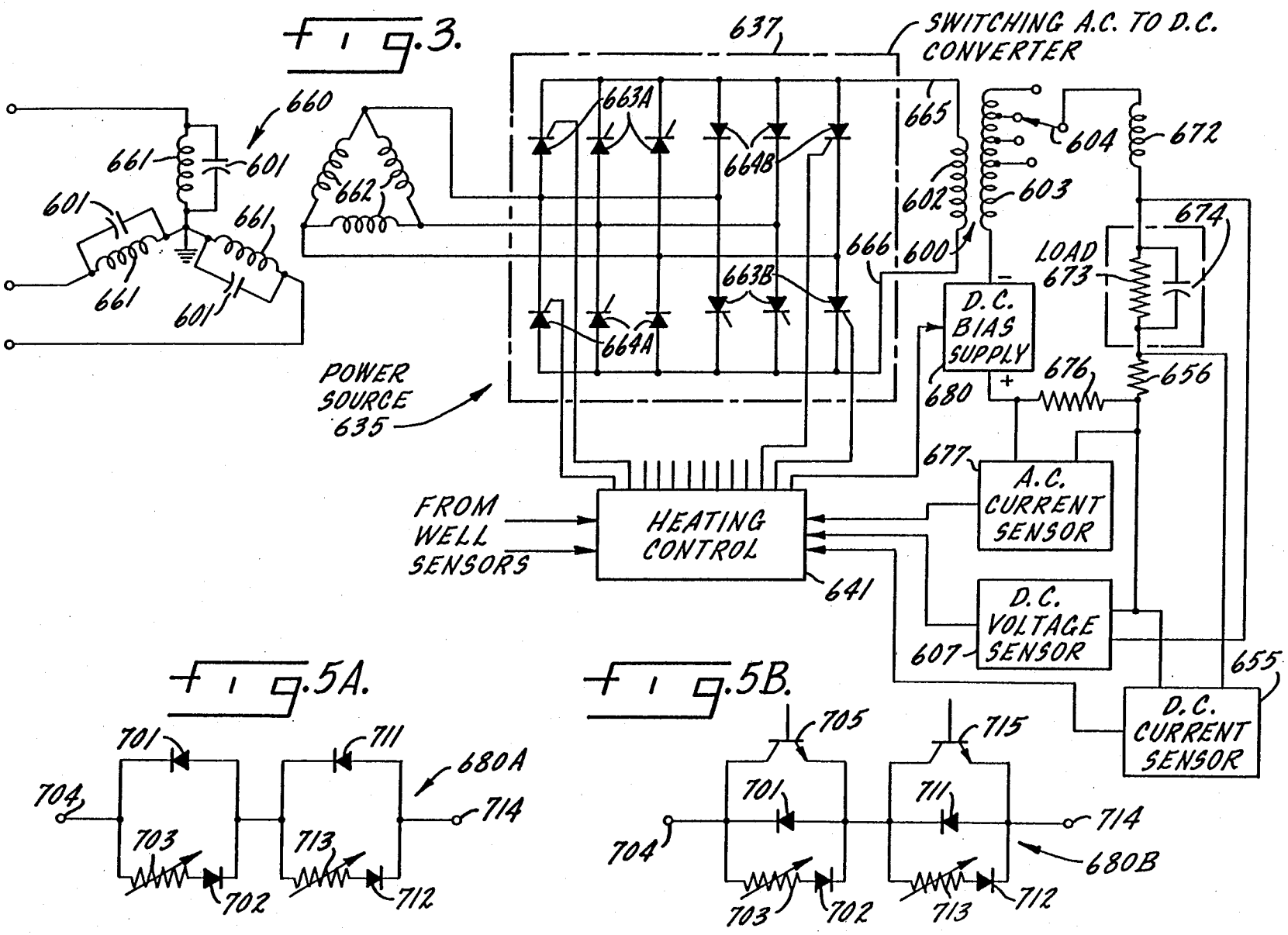
FIG. 3 is a circuit diagram of an electrical energizing circuit incorporating a D.C. bias source in accordance with the invention.
FIGS. 5A and 5B are circuit diagrams of alternate forms of the D.C. bias source.

FIG. 3 illustrates a power source 635 that may be utilized as the power source in the systems of FIGS. 1 and 2, and in other downhole electromagnetic heating systems, to carry out the objectives of the present invention. The circuit of power source 635 includes an input transformer 660 of the wye-delta type, with power factor correction capacitors 601 connected in parallel with the input windings 661. The output windings 662 are connected to a combined A.C. to D.C. converter and switching unit 637 utilizing both positively polarized SCRs 663A and 663B and negatively polarized SCRs 664A and 664B in a cyclo-converter circuit having two output conductors 665 and 666.

In power source 635 the output lines 665 and 666 from switching rectifier 637 are connected to the primary winding 602 of an output transformer 600. The secondary winding 603 of transformer 600 is equipped with a tap changer 604 to provide major changes in the amplitude of the heating current supplied to the output circuit, which comprises a current limiting coil 672, a load resistance 673, and a capacitance 674. Load 673 represents the casing or other conductive means for supplying an A.C. heating current to a downhole main heating electrode, that heating electrode, the return electrode, and the portions of intervening earth formations between the two electrodes. As in any and all of the well systems that use steel pipe, the load resistance 673 may be quite non-linear.

Power source 635 is a cyclo-converter. It includes a heating control 641 that supplies firing signals to the gate electrodes of all of the SCRs in switching rectifier circuit 637. Heating control 641 has inputs from appropriate temperature sensors, flow sensors, pressure sensors, and other sensors in the well or in the formations adjacent the well, and may be connected to an external computer if utilized in conjunction with other similar power sources at different wells. It also includes an A.C. current sensor 677 connected to a shunt resistance 676 in the heating circuit; the output of sensor 677 is supplied to heating control 641. A D.C. voltage sensor 607 may be connected across load 673, with its output also applied to heating control 641. A shunt resistor 656, in series in the heating circuit for the well, is connected to a D.C. current sensor 655. The output of sensor 655 is applied to heating control 641.

At the input to power source 635, each capacitor 601 serves as a part of a power factor correction circuit. The SCRs in the A.C. to D.C. conversion unit 637 are connected in a complete three-phase switching rectifier bridge that supplies positive and negative-going power to both of the conductors 665 and 666; the SCRs are fired in sequence, in a well-known manner, under control of gate firing signals from heating control 641.

Power source 635 supplies heating power to load 673 with a waveform 510 approximating that of a square wave, as illustrated in FIG. 4A. The positively polarized SCRs 663A and 663B supply the positive portions of the square wave signal, being fired to develop that portion of the electrical power supplied to the load, whereas the negative SCRs 664A and 664B are fired to produce the negative portions of waveform 510. The ripple in waveform 510 is from the 50/60 Hz input.

By delaying the firing of the positive-going SCRs 663A and 663B, the amplitude of the positive portion of waveform 510 can be modified and the positive-going current $I_p$ can be reduced in amplitude as shown in FIG. 4B, waveform 511. Similarly, by delaying the firing of the negative-going SCRs 664A and 664B, the amplitude $I_n$ of the negative portions of the pseudo square wave can be reduced, particularly as shown by the negative half cycle of waveform 511 in FIG. 4B. Symmetrical alteration of the timing of firing of the SCRs provides effective proportional duty cycle control, reducing the overall amplitude of the pseudo square wave as supplied to load 673 and thus reducing the power applied to downhole heating.

The timing of the firing signals supplied from circuit 641 to the SCRs in rectifier 637 is controlled from heating control 641, which in turn may be controlled by an appropriate operations programmer (not shown) for a plurality of wells, capable of selecting either proportional duty cycle control or ON/OFF (bang-bang) control for the SCRs; see the aforementioned application of J. E. Bridges Ser. No. 322,930 and the related application of J. E. Bridges et al, Ser. No. 322,911, both filed concurrently herewith. When ON/OFF control is selected, overall heating rate control is limited to that afforded by a series of adjustable taps 604 on the secondary winding of output transformer 600. Heating control 641 may be made responsive to various sensors, including sensors located at the top of the well and/or other sensors positioned downhole of the well in the immediate vicinity of the main heating electrode; see suggested sensor locations in FIG. 2. The sensor inputs to control 641 are employed to maintain the operating temperature of the main heating electrode or the deposit within appropriate limits in order to maximize electrode life and preclude unwanted side effects due to excessive temperatures.

Major changes in the heating current supplied to load 673 by power source 635 are achieved by tap changer 604 in the secondary 603 of the output transformer 600. The presence of output transformer 600 in the circuit precludes effective development of a corrosion inhibiting D.C. bias on load 673 through any control applied to the gating signals for the SCRs in switching rectifier circuit 637. Consequently, a separate D.C. bias supply 680 is included in the heating circuit comprising load 673.

Utilizing conventional cathodic protection apparatus, D.C. bias supply 680 might include an A.C. powered separate D.C. bias supply or it might comprise a polarization cell. But the use of either of these two expedients, employing apparatus of the kind usually used in cathodic protection arrangements for pipelines and oil wells, is quite difficult, to the extent of being impractical or unduly expensive.

Thus, a conventional A.C. powered D.C. bias supply, having a controllable D.C. voltage or current output, might be utilized as D.C. bias supply 680 of FIG. 3. But equipment of this kind as customarily used in the oil industry cannot withstand continuous operation at the levels of A.C. current required for load 673 which, as previously noted, are usually in the range of 50 to 1000 or more amperes at frequencies of 0.01 to 35 Hz. Thus, the electrolytic capacitors normally used in such A.C. powered D.C. bias supplies cannot withstand such high A.C. currents, particularly at low frequencies, without highly deleterious effects on their reliability and operation. As a consequence, substantially more expensive capacitors must be used and other design revisions are also likely to be required. The conventional A.C. powered D.C. bias supply, when modified for the circuit of FIG. 3 as device 680, is too expensive to be economically practical.

Theoretically, a conventional polarization cell might be inserted in the circuit of FIG. 3 as the D.C. bias supply 680. Such a cell operates to inhibit corrosion by building up a polarity opposite to that generated by naturally occurring D.C. currents. In many installations, it is capable of developing a neutralizing potential that offsets the naturally occurring D.C. currents causing corrosion. Again, however, the use of polarization cells employing presently available constructions poses substantial difficulties.

A polarization cell of conventional construction, while designed to withstand heavy surges of current and voltage such as those derived from lightning, cannot withstand a continuous A.C. current, at the levels required for heating load 673, without appreciable evaporation of the electrolyte that is an integral and essential part of the polarization cell. Consequently, a substantially larger and more complex cell, of a construction as yet not fully ascertainable, would have to be used as D.C. bias supply 680. It appears that such a cell would be so expensive as to mitigate against its use, economically, as the D.C. bias supply in the circuit of FIG. 3.

FIG. 5A illustrates a relatively simple and inexpensive circuit 680A that may be employed as the D.C. bias supply in power source 635, FIG. 3, or in other oil well heating system power sources that utilize output transformers. Circuit 680A, which has input/output terminals 704 and 714, includes two diodes or other semiconductor devices 701 and 702 connected in parallel with each other and in opposite polarities. An adjustable resistor 703 may be connected in series with one of the diodes, in this instance diode 702. The circuit 701–703 is connected in series with a further circuit of a diode 711 in parallel with a diode 712; an adjustable resistor 713 is shown in series with diode 712.

In bias supply 680A, devices 701 and 711 are selected to have substantially different band-gap energies from devices 702 and 712. For example, if diodes 701 and 711 are both germanium or Schottky diodes, and diodes 702 and 712 are both silicon diodes, this condition is met. The forward voltage drop across each of devices 701 and 711 will then be approximately 0.2 volts, whereas the forward voltage drops across each of devices 702 and 712 is about 0.8 volts. This produces a net differential of approximately 1.2 volts D.C. across terminals 704 and 714 of circuit 680A, due to the A.C. currents flowing in that circuit when it is employed in a heating circuit as a D.C. bias supply in the manner shown in FIG. 3. This is a voltage level quite suitable for cathodic protection of the main downhole electrode that is a part of load 673. Resistors 703 and 713 are provided to permit adjustment of the overall bias; by changing these resistances, the bias can be adjusted to meet operating requirements. It should be understood that resistors 703 and 713 may be signal-variable resistances, actuated by a control signal from heating control 641 or directly from an appropriate sensor, such as sensor 655, that determines the net D.C. current in the heating loop that includes load 673. The positions of the variable resistances 703 and 713 can be changed; they could equally well be in series with diodes 701 and 711. The net bias current can also be changed by control of the temperatures of the diodes or other semiconductor devices in circuit 680A.

Variable control of the D.C. bias current can also be achieved by paralleling devices 701 and 711 with two transistors 705 and 715 as shown in FIG. 5B. During each cycle of the A.C. heating current, terminal 704 will at one time be driven positive relative to terminal 714. At this point diodes 701 and 711 do not conduct, but diodes 702 and 712 are conductive. The voltage between terminals 704 and 714 is a function of the resistances 703 and 713 and the forward saturation voltages of diodes 702 and 712. By adjusting these values, sufficient voltage can be developed to permit transistors 705 and 715 to function as variable resistances. By varying the emitter input currents to transistors 705 and 715, the amplitudes of the currents which are shunted away by these transistors, and which would otherwise pass through circuit elements 702, 703, 712 and 713, can be varied. The base drive currents for transistors 705 and 715 may be derived from D.C. current sensor 655.

The circuits for D.C. bias sources that are shown in FIGS. 5A and 5B are illustrative of potentially practical circuits, but are far from exhaustive. Numerous other arrangements are possible. For example, in some installations a single bias circuit of the kind shown in FIG. 5A, with just one diode in each branch of the circuit and one adjustable resistor, may be quite adequate. This applies also to the circuits of FIG. 5B. In a given installation, one pair of diodes, one switching transistor, and one adjustable resistor may be adequate for the requirements of the well in which the D.C. bias supply is employed.

Figure 6:
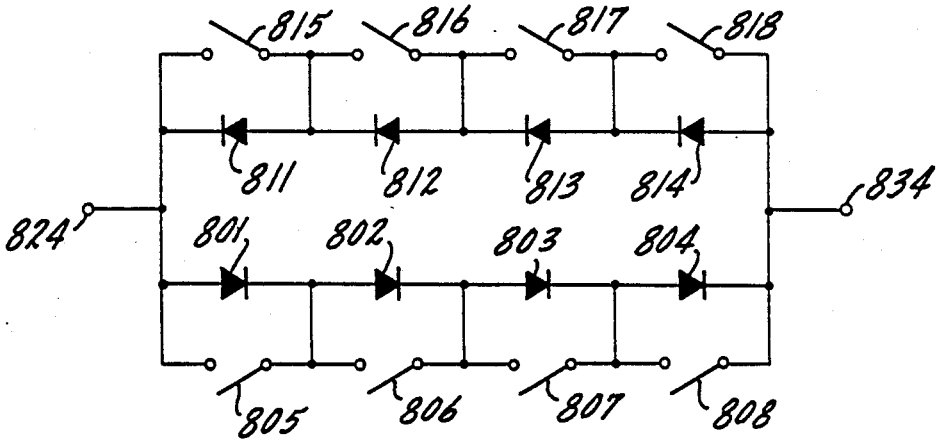
FIG. 6 is a circuit diagram of a controllable form of the D.C. source.

On the other hand, in some installations, particularly those in which there are substantial variations in operating conditions as discussed more fully hereinafter, adequate cathodic protection may require greater control of the low amplitude D.C. bias current employed for this purpose and may require a bias circuit of somewhat greater complexity. FIG. 6 illustrates a possible commercial prototype for a D.C. bias control circuit suitable for downhole electrical heating. In this instance, one series of diodes 801, 802, 803 and 804 are connected in series with each other between an input terminal 824 and an output terminal 834. A similar series of diodes 811, 812, 813, and 814, are connected in series between terminals 824 and 834, in parallel with diodes 801-804. Each of the diodes 801 through 804 can be shorted out, individually and selectively, by closing any one of a series of control switches 805, 806, 807 and 808. Similarly, each of the individual diodes 811–814 can be effectively shorted out by the closing of one of a series of individual control switches 815, 816, 817, and 818. Although switches 805–808 and 815–818 are shown as constituting mechanical switches, it should be understood that each of them can be a bi-directional semiconductor switching device or any other form of switch subject to electrical control. Thus, each of these switches should be subject to automatic control from the signals developed by D.C. current sensor 655 (FIG. 3) and supplied to heating control system 641 for use in developing appropriate control signals for the D.C. bias supply.

In FIG. 6, each of the diodes, 801–804 has a predetermined forward voltage drop or work function. The diodes could all be of the same kind or, for even more precise control, the diodes may have different work functions. For example, the work function for diode 801 might be as low as one-third of a volt, as in the case of a germanium diode. Another diode in the series, such as diode 802, may have a forward voltage drop or work function of one-half volt as in the case of a Shottky diode. Indeed, the work function or forward voltage drop may be as much as 1.2 volts as in the case of a silicone diode. It can thus be seen that various combinations of voltages can be obtained by an arrangement as shown in FIG. 8, with the overall work function for the circuit determined by closing of the various control switches 805–808 and 815–818. By selective actuation of the control switches in the circuit of FIG. 6, it is possible to obtain precise and critical control of the overall D.C. voltage drop, through the circuit, than might otherwise be possible with a simpler circuit such as those of FIGS. 5A and 5B. Of course, it will be recognized that the most precise control in a circuit such as FIG. 6 is obtainable with the use of a large number of diodes having quite low work functions, though at some expense insofar as the number of diodes is concerned.

Figure 7:
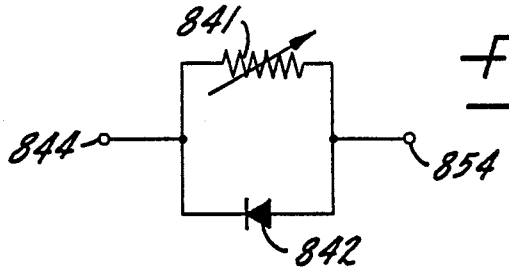
FIG. 7 is a circuit diagram of another bias source.

FIG. 7 shows another simple circuit that may be utilized as a bias source for the present invention. This circuit, having circuit terminals 844 and 854, includes only a resistor 841 in one branch and a diode 842 in a parallel branch. For some degree of control, resistor 841 may be an adjustable resistor. The function is similar to the circuits discussed in connection with FIGS. 5A and 5B but the circuit is simpler and may be less expensive. On the other hand, the range of control may be inadequate for a given installation, though this can be increased by use of multiple circuits of the sort shown in FIG. 7. Any of the bias circuits of FIGS. 5A, 5B, 6 and 7 may, of course, be made as a part of an integrated circuit, on a single substrate or within one package. Other types of semiconductor phenomena can be employed to obtain the desired asymmetrical characteristics, so that there is a net D.C. voltage differential of the desired polarity for corrosion inhibition developed across the bias circuit. Broadly speaking, the required characteristics are such that a net voltage drop across the bias source of the order of one-third volt to as high as several volts is necessary to offset D.C. corrosion currents that would otherwise be present.

For a more complete understanding of the method and apparatus of the present invention, consideration of the electrical phenomena that occur in an electromagnetic heating system for an oil well or other mineral fluid well, of the kind including a main heating electrode deep in the well and a return electrode electrically remote from the main heating electrode, is desirable. FIG. 8 illustrates the D.C. voltage and D.C. current between a downhole main heating electrode, in a system of this kind, and each of two return electrodes. In this instance, each return electrode was the casing of an adjacent oil well. With no A.C. heating current in the system the first circuit, curve 901, had a D.C. offset voltage of about −58 millivolts and a D.C. current just under one ampere. The current in the other system, curve 902, again with no applied A.C. heating current, showed a voltage differential of approximately −68 millivolts and a current of nearly 1.2 amperes. These naturally induced voltage differentials and currents arise because of different characteristics in the metal, the electrolytes, and temperatures between the main electrode in the well under study and the return electrodes. They demonstrate the adequacy of the D.C. voltages and currents developed by circuits like those of FIGS. 5A through 7 for counteracting naturally occurring corrosion-inducing voltages and currents.

In the wells from which FIG. 8 was obtained, the D.C. offset current of each return electrode decreased as the A.C. heating current increased, over a range of zero to 450 amperes. However, it is equally likely that the D.C. offset current would increase, as to two or three amperes, in response to application of increasing A.C. heating excitation currents. Whether or not the D.C. offset current (and voltage) is increased or decreased in response to the A.C. heating current depends upon the materials used for the electrodes and on the electrolytes in the immediate vicinity of each of the electrodes. It should also be noted that the amplitude of the A.C. current required for well heating is a function of the flow rate of fluids from the deposit or reservoir into the well. The flow rate, and hence the heating current demand, changes appreciably over extended periods of time, and precludes the effective use of a fixed cathodic or current neutralization bias.

In considering the features and requirements of the invention, it may also be noted that use of high negative cathodic protection potentials may result in the accumulation of excessive scale on the main electrode, in this instance the main heating electrode deep in the well at the level of the mineral reservoir. An excessive accumulation of scale around the main heating electrode may plug up the perforations in that electrode or may block the screens present in many wells. The scale is also likely to interfere with electrical operation of the electrode. Thus, to achieve the full benefits of the present invention it is important to be able to adjust the D.C. bias in accordance with changing conditions, in and around the well, to keep the D.C. corrosion protection current at a minimum. That is the reason for the control elements 703, 713, 705 and 715 in FIGS. 5A and 5B, the switches 805–808 and 815–818 in FIG. 6, and variable resistor 841 in FIG. 7. Of course, variable resistances can be added in FIG. 6, if desired, for further fine gain control. When the corrosion protection voltage and current are held to a minimum, excessive corrosion of the return electrodes is avoided, scale accumulation on the downhole main heating electrode is minimized, and well life is prolonged.

For further background, the situation of two widely separated electrodes embedded in the earth may be considered in relation to the cathodic protection concepts of the invention. Typically, the formations around each electrode have different chemical constituents; the electrode lengths are also likely to be substantially different. Under these circumstances, due to differences in lengths and in the encompassing chemical constituents, a D.C. potential is developed between the two electrodes. When these two electrodes are connected at one end only, a D.C. current flows through the interconnection, the return path being the earth formations. This is the situation for zero A.C. current in FIG. 8. Of course, this causes one of the electrodes to be positive and the other to be negative with respect to the earth. Virtually all corrosion will occur at the electrode that is positive relative to the earth. A calculation of the amount of metal loss at this positive electrode, on a worst case basis, using purely electrochemical considerations, indicates that for a current density of one milliampere per square centimeter, approximately 12 millimeters will be removed from the surface of a steel plate over a period of one year. This, of course, represents a substantial erosion rate.

The impact of D.C. currents, in situations such as those under discussion, is further illustrated in Tables 1 and 2. Table 1 shows metal thickness loss by erosion, in millimeters, over a period of ten years for an electrode 0.2 meters in diameter; it assumes a one ampere D.C. current uniformly distributed over the electrode arising, for example, from electrochemical potentials developed between two widely separated electrodes in different earth media. For a D.C. current of ten amperes, the erosion rates would be ten times as great as indicated in Table 1. A naturally occurring D.C. current of one ampere is not exceptional; see FIG. 8. Currents up to about ten amperes can occur.

Table 2 shows the impact of an A.C. voltage and resulting A.C. current applied to the same electrodes as in Table 1. For the A.C. current, rather than a D.C. current, the corrosion rates are substantially smaller. At a frequency of 60 Hz, the corrosion rate is typically only about 0.1% of that for an equivalent D.C. current density. However, theoretical considerations suggest that the corrosion rate may be approximately inversely proportional to the frequency. Thus, for a 6 Hz A.C. current, as shown in Table 2, the corrosion rate could be about ten times that occurring at 60 Hz. It should be noted that the relationships indicated between corrosion rates for A.C. and D.C. signals, in Tables 1 and 2, are nominal values and may vary, in practice, by as much as an order of magnitude above and below the values set forth in the tables.

TABLE 1

| (1 Ampere Current, D.C.) | | |
|---|---|---|
| Electrode Length, Meters | Current Density $mA/cm^2$ | Erosion, Millimeters/ 10 Years |
| 1 | 0.16 | 18.5 |
| 10 | 0.016 | 1.85 |
| 100 | 0.0016 | 0.185 |
| 1000 | 0.00016 | 0.0185 |

TABLE 2

| (100 Ampere Current, A.C.) | | | |
|---|---|---|---|
| Electrode Length, Meters | Current Density, $MA/cm^2$ | 60 Hz Erosion mm/10 Yrs. | 6 Hz Erosion mm/10 Yrs. |
| 1 | 16 | 1.85 | 18.5 |
| 10 | 1.6 | 0.185 | 1.85 |
| 100 | 0.16 | 0.0185 | 0.185 |
| 1000 | 0.016 | 0.00185 | 0.0185 |

In all embodiments of the invention, of course, the D.C. bias current should be in a direction to maintain the downhole main heating electrode preferably negative relative to the return electrode(s), but in any event at a level as close to zero as practically possible without actually going to zero. Thus, bias currents in the milliampere range are much preferred. With an output transformer coupling the A.C. power to the heating system, a separate D.C. supply on the secondary side of that transformer is used. The circuits of the present invention are highly advantageous when utilized for this purpose.

We claim:

1. In an electromagnetic heating system for an oil well or other mineral fluid well, including a main heating electrode located downhole in the well at a level adjacent a mineral fluid deposit, and a return electrode located such that an electrical current between the electrodes passes through and heats a portion of the mineral fluid deposit, an electrical energizing apparatus including an A.C. power source for generating a high amplitude A.C. heating current, of at least fifty amperes, a D.C. bias source for generating a low amplitude D.C. bias current having a given polarity such as to inhibit corrosion at the main electrode, and connection means for applying both the A.C. heating current and the D.C. bias current to the electrodes of the well heating system, the improvement in which the D.C. bias source comprises a bias circuit, connected to a heating circuit that includes the A.C. power source, the bias circuit including at least one semiconductor device and developing a net D.C. voltage differential of the given polarity in response to the A.C. heating current.

2. Electrical energizing apparatus for A.C. heating and D.C. corrosion inhibition in a mineral fluid well, according to claim 1, in which the bias circuit further includes amplitude adjusting means for maintaining the bias current below a given amplitude.

3. Electrical energizing apparatus for A.C. heating and D.C. corrosion inhibition in a mineral fluid well, according to claim 2, in a heating system including D.C. sensor means for sensing the D.C. bias current, in which the amplitude adjusting means is actuated by the D.C. sensor means, and maintains the D.C. bias current below a given amplitude of about one ampere.

4. Electrical energizing apparatus for A.C. heating and D.C. corrosion inhibition in a mineral fluid well, according to claim 1, in which the bias circuit includes a pair of semiconductor devices connected in parallel with each other but with reversed polarities, the devices having different forward voltage drops.

5. Electrical energizing apparatus for A.C. heating and D.C. corrosion inhibition in a mineral fluid well, according to claim 4, in which the bias circuit further includes amplitude adjusting means for maintaining the bias current below a given amplitude.

6. Electrical energizing apparatus for A.C. heating and D.C. corrosion inhibition in a mineral fluid well, according to claim 5, in a heating system including D.C. sensor means for sensing the D.C. bias current, in which the amplitude adjusting means is actuated by the D.C. sensor means, and maintains the D.C. bias current below a given amplitude of about one ampere.

7. Electrical energizing apparatus for A.C. heating and D.C. corrosion inhibition in a mineral fluid well, according to claim 1, in which the bias circuit includes a semiconductor device connected in parallel with a resistor.

8. Electrical energizing apparatus for A.C. heating and D.C. corrosion inhibition in a mineral fluid well, according to claim 7, in which the bias circuit further includes amplitude adjusting means for maintaining the bias current below a given amplitude.

9. Electrical energizing apparatus for A.C. heating and D.C. corrosion inhibition in a mineral fluid well, according to claim 8, in a heating system including D.C. sensor means for sensing the D.C. bias current, in which the amplitude adjusting means is actuated by the D.C. sensor means, and maintains the D.C. bias current below a given amplitude of about one ampere.

10. Electrical energizing apparatus for A.C. heating and D.C. corrosion inhibition in a mineral fluid well, according to claim 1, in which the bias circuit includes two parallel-connected branch circuits, each including at least one semiconductor device, the sum of the work functions for the semiconductor devices in one branch circuit being substantially different from the sum of the work functions for the semiconductor devices in the other branch circuit.

11. Electrical energizing apparatus for A.C. heating and D.C. corrosion inhibition in a mineral fluid well, according to claim 10, in which one branch of the bias circuit further includes amplitude adjusting means for maintaining the bias current below a given amplitude.

12. Electrical energizing apparatus for A.C. heating and D.C. corrosion inhibition in a mineral fluid well, according to claim 11, in a heating system including D.C. sensor means for sensing the D.C. bias current, in which the amplitude adjusting means is actuated by the D.C. sensor means, and maintains the D.C. bias current below a given amplitude of about one ampere.

13. Electrical energizing apparatus for A.C. heating and D.C. corrosion inhibition in a mineral fluid well, according to claim 1, in which the D.C. bias source comprises a plurality of bias circuits connected in series with each other and connected to a heating circuit that includes the A.C. power source, each bias circuit including at least one semiconductor device and developing a net D.C. voltage differential of the given polarity in response to the A.C. heating current.

14. Electrical energizing apparatus for A.C. heating and D.C. corrosion inhibition in a mineral fluid well, according to claim 13, in which each bias circuit further includes amplitude adjusting means for maintaining the bias current below a given amplitude.

15. Electrical energizing apparatus for A.C. heating and D.C. corrosion inhibition in a mineral fluid well, according to claim 14, in a heating system including D.C. sensor means for sensing the D.C. bias current, in which each of the amplitude adjusting means is actuatable by the D.C. sensor means, so that the bias source maintains the D.C. bias current below a given amplitude of about one ampere.

16. Electrical energizing apparatus for A.C. heating and D.C. corrosion inhibition in a mineral fluid well, according to claim 1, in which the bias circuit includes a first plurality of semiconductor devices that are connected in series with each other and in parallel with a second plurality of semiconductor devices that are in series with each other.

17. Electrical energizing apparatus for A.C. heating and corrosion inhibition in a mineral fluid well, according to claim 16, in which the bias circuit further includes a plurality of control switches for individually bypassing selected ones of the semiconductor devices.

18. Electrical energizing apparatus for A.C. heating and D.C. corrosion inhibition in a mineral fluid well, according to claim 17, in a heating system including D.C. sensor means for sensing the D.C. bias current, in which the control switches are actuated by the D.C. sensor means to maintain the D.C. bias current below a given amplitude of about one ampere.

19. Electrical energizing apparatus for A.C. heating and D.C. corrosion inhibition in a mineral fluid well, according to claim 1, in which the frequency of the A.C. heating current is in the range of about 0.01 to 35 Hz.

20. Electrical energizing apparatus for A.C. heating and D.C. corrosion inhibition in a mineral fluid well, according to claim 1, in which the connection means comprises an output transformer, and the D.C. bias source is connected to the secondary of the output transformer.

21. Electrical energizing apparatus for A.C. heating and D.C. corrosion inhibition in a mineral fluid well, according to claim 20, in a heating system including D.C. sensor means for sensing the D. C. bias current, in which the D.C. bias circuit further comprises amplitude adjusting means, actuated by the D.C. sensor means, for maintaining the D.C. bias current below a given amplitude of about one ampere.

22. Electrical energizing apparatus for A.C. heating and D.C. corrosion inhibition in a mineral fluid well, according to claim 21, in which the frequency of the A.C. heating current is in the range of about 0.01 to 35 Hz.

23. Electrical energizing apparatus for A.C. heating and D.C. corrosion inhibition in a mineral fluid well, according to claim 22, in which the semiconductor devices are diodes.

24. In an electromagnetic heating system for an oil well or other mineral fluid well, including a main heating electrode located downhole in the well at a level adjacent a mineral fluid deposit, and a return electrode at a location remote from the main electrode such that an electrical current between the electrodes passes through and heats a portion of the mineral fluid deposit, an electrical energizing apparatus including an A.C. power source for generating a high amplitude A.C. heating current, of at least one hundred amperes, a D.C. bias source for generating a low amplitude D.C. bias current having a polarity such as to inhibit corrosion at the main electrode, connection means for applying both the A.C. heating current and the D.C. bias current to the electrodes of the well heating system, and D.C. sensor means for sensing the D.C. bias current, the improvement in which the D.C. bias source comprises:

a bias circuit including a pair of semiconductor devices connected in parallel with each other but with reversed polarities, the devices having different work functions; and amplitude adjusting means, actuated by the D.C. sensor means, for maintaining the D.C. bias current below a given amplitude of about one ampere.

25. Electrical energizing apparatus for A.C. heating and D.C. corrosion inhibition in a mineral fluid well, according to claim 24, in which the amplitude adjusting means comprises a variable impedance connected in series with one of the semiconductor devices.

26. Electrical energizing apparatus for A.C. heating and D.C. corrosion inhibition in a mineral fluid well, according to claim 25, in which the semiconductor devices are diodes.

27. Electrical energizing apparatus for A.C. heating and D.C. corrosion inhibition in a mineral fluid well, according to claim 26, in which the frequency of the A.C. heating current is in the range of 0.01 to 35 Hz.

28. Electrical energizing apparatus for A.C. heating and D.C. corrosion inhibition in a mineral fluid well, according to claim 24, in which the amplitude adjusting means comprises a variable impedance semiconductor device connected in parallel with the bias circuit.

* * * * *